US005992994A

United States Patent [19]

Rasmussen et al.

[11] Patent Number: 5,992,994

[45] Date of Patent: Nov. 30, 1999

[54] LARGE INKJET PRINT SWATH MEDIA SUPPORT SYSTEM

[75] Inventors: Steve O. Rasmussen, Vancouver, Wash.; Paul D. Gast, Barcelcha, Spain

[73] Assignee: Hewlett-Packard Company, Palo Alto, Calif.

[21] Appl. No.: 08/595,009

[22] Filed: Jan. 31, 1996

[51] Int. Cl.[6] ..... B41J 2/01

[52] U.S. Cl. ..... 347/104

[58] Field of Search ..... 347/104, 8, 101; 400/634, 635; 226/170–173, 43, 95, 74, 75, 174, 175, 176, 177; 271/198–201, 194, 196, 276; 399/406, 329; 198/818, 822, 844.1, 850

[56] References Cited

U.S. PATENT DOCUMENTS

| | | | |
|---|---|---|---|
| 4,207,579 | 6/1980 | Gamblin et al. | 346/75 |
| 4,447,817 | 5/1984 | Naramore | 346/75 |
| 4,660,752 | 4/1987 | Rikard etal. | 226/95 |
| 4,682,904 | 7/1987 | Yoshimura et al. | 400/616 |
| 4,821,049 | 4/1989 | Eckl | 347/104 |
| 5,051,761 | 9/1991 | Fisher et al. | 346/140 R |
| 5,276,970 | 1/1994 | Wilcox et al. | 33/18.1 |
| 5,342,133 | 8/1994 | Canfield | 400/635 |
| 5,345,863 | 9/1994 | Kurata et al. | 347/8 |
| 5,393,151 | 2/1995 | Martin et al. | 400/642 |
| 5,419,644 | 5/1995 | Martin et al. | 347/8 |
| 5,468,076 | 11/1995 | Hirano et al. . | |
| 5,548,388 | 8/1996 | Schieck | 355/309 |
| 5,593,240 | 1/1997 | Broder et al. | 400/352 |

FOREIGN PATENT DOCUMENTS

| | | | |
|---|---|---|---|
| 0640479A | 3/1995 | European Pat. Off. | B41J 2/01 |
| 60-48385 | 3/1985 | Japan | 347/104 |

OTHER PUBLICATIONS

Patent Abstracts of Japan, vol. 017, No. 469, Aug. 26, 1993 & JP 05 112001 A (Canon, Inc.) May 7, 1993.

Patent Abstracts of Japan, vol. 096, No. 003, Mar. 29, 1996 & JP 07 304167 (Hitachi Koki Co. Ltd.) Nov. 21, 1995.

*Primary Examiner*—John Barlow
*Assistant Examiner*—Juanita Stephens
*Attorney, Agent, or Firm*—Flory L. Martin

[57] ABSTRACT

To maintain a uniform spacing between the print media, such as paper, and an inkjet printhead having a large print swath, for instance about 25 millimeters (one inch) wide, a new media support system is provided for inkjet printing mechanisms, such as printers or plotters. The support system employs an endless belt driven from the belt interior surface by a roller drive system that uniformly supports the print media under the reciprocating printhead. The belt may be lined with anti-cockle ribs to support the media when saturated. The belt may also be foraminous, with a vacuum applied thereunder to pull the media onto the belt. A method is also provided for supporting and transporting a large sheet of print media through a printzone of an inkjet printing mechanism, such as an inkjet plotter, that uses such a large swath inkjet printhead.

39 Claims, 6 Drawing Sheets

LARGE INKJET PRINT SWATH MEDIA SUPPORT SYSTEM

FIELD OF THE INVENTION

The present invention relates generally to inkjet printing mechanisms, such as printers or plotters. More particularly the present invention relates to a media support system for maintaining a uniform spacing between the print media, such as paper, and an inkjet printhead having a large print swath, for instance about 20 millimeters to 25 millimeters (about one inch) wide or wider.

BACKGROUND OF THE INVENTION

Inkjet printing mechanisms may be used in a variety of different products, such as plotters, facsimile machines and inkjet printers, to print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with a full supply of ink back and forth across the sheet. Other inkjet print mechanisms, known as "off-axis" systems, propel only a small ink supply with the printhead carriage across the print zone, and store the main ink supply in a stationary reservoir, which is located "off-axis" from the path of printhead travel. Typically, a flexible conduit is used to convey the ink from the off-axis main reservoir to the printhead cartridge. In multi-color cartridges, several printheads and reservoirs are combined into a single unit, with each reservoir/printhead combination for a given color also being referred to herein as a "pen."

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To clean and protect the printhead, typically a "service station" mechanism is mounted within the plotter chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit or other mechanism that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the face of the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass.

It is apparent that the speed of printing a sheet can be increased if the swath width is increased. That is, a printhead with a wider swath would require fewer passes across the sheet to print the entire image, and fewer passes would increase the throughput of the printing mechanism. "Throughput," also known as the pages-per-minute rating, is often one of major considerations that a purchaser analyzes in deciding which printing mechanism to buy. While it may seem to the inexperienced an easy thing to accomplish, merely lengthening the nozzle array to increase throughput, this has not been the case. For thermal inkjet pens in particular, there are some physical and/or manufacturing constraints to the size of the substrate layer within the printhead. In the past, inkjet printheads have been limited in swath width to around 5.4 mm (millimeters) for tri-chamber color printheads, and around 12.5 mm (about one-half inch) for monochrome printheads, such as black printheads.

Recent breakthroughs in technology have given hope to developing a printhead with a 25 mm swath width (about one inch wide), which is double the width previously obtainable, and future developments may bring about even wider swath printheads. Unfortunately, the possibility of a wider swath width brings on other problems which have not previously been encountered, such as how to provide a uniformly level printing surface under the wider printhead. This media support issue is a significant problem in large format inkjet plotters, which feed media (e.g. paper) from a large roll for printing D-sized or E-sized engineering or architectural drawings, or posters, for instance. The length of the printzone in these plotters is often over a meter (around four feet).

In the past, with a 12.5 mm (one-half inch) wide print swath, the media was adequately supported by a roller which ran across the entire length of the printzone. Using a roller with a diameter of about 75 mm (about three inches) supported the media nearly linearly at the one-half inch print swath across the entire printzone. That is, any variation in the media-to-printhead spacing along the length of the nozzle array yielded visually acceptable deviations in print quality using the earlier smaller swath printheads. While a simple answer may be to increase the roller diameter to accommodate the new larger printhead, in a commercially viable plotter, such a larger diameter roller would not be acceptable. A larger diameter roller would not only increase the cost and weight of the plotter, but it would also increase the overall size of the plotter, an undesirable side effect in today's compact office environments.

Another significant problem in these large format plotters is advancing the media very accurately from one print swath to the next. One system for moving the media through the plotter printzone is shown in U.S. Pat. No. 5,342,133 ("the '133 patent"), which is assigned to Hewlett-Packard Company, the assignee of the present invention. The plotter of the '133 patent grips the edges of the media to move it through the printzone. While the '133 patent worked well for the earlier inkjet pens having only a 12.5 mm (one-half inch) print swath, it was unable to maintain the uniform printhead to media spacing required for a 25 mm (one inch) wide printhead because the majority of the print swath was unsupported.

In large format plotters, the stiffness of the typical media (paper) is insufficient to enable driving the media along its edges while maintaining good positional accuracy in the middle of the sheet. That is, when the media is only supported along its edges, it tends to sag under its own weight, increasing the printhead-to-media spacing near the middle of the sheet, which can blur the center of the printed image. This deficiency of the '133 patent plotter becomes even more evident when printing an image that requires a large quantity of ink, which causes the media, especially paper, to become saturated and soggy.

For instance, plotters are typically used to print engineering and architectural drawings, but recent advances in technology make the printing of enlarged photographic images (e.g. posters) on D-sized and E-sized drawings now possible, both technologically and economically. These posters typically carry images that require far more ink than the typical engineering or architectural drawing, so there is a greater tendency for a poster image to saturate the media with ink, causing an undesirable effect known in the art as "cockle." The term cockle refers to the tendency of media, such as paper, to uncontrollably bend or buckle as the wet ink saturates the fibers of the medium and causes them to expand. This buckling or cockling causes the media to uncontrollably bend either downwardly away from the printhead, or upwardly toward the printhead, with either motion undesirably changing the printhead-to-media spacing and leading to poor print quality. Moreover, upward buckling can be extreme enough to cause the media to contact the printhead and possibly clog a nozzle and/or smear ink on the media, damaging the image.

Thus, a whole new market is now open for plotters having a high print quality and a high throughput, so that high quality poster-sized images may be rapidly printed, as well as the conventional engineering and architectural drawings.

SUMMARY OF THE INVENTION

One aspect of the present invention addresses the printhead-to-media spacing problem by providing a media support system for an inkjet printing mechanism. Such a printing mechanism typically has a chassis with an inkjet printhead mounted thereto for reciprocal movement along a scanning axis across a printzone. The media support system includes an endless belt having an interior surface and an exterior surface. A transport system has a drive member that engages the belt and a drive motor that selectively drives the drive member. The support system also has at least one support member, parallel to the scanning axis, that engages the interior surface of the belt adjacent the printzone to define a support zone along a portion of the belt exterior surface to support media thereon in a print plane under the length of the nozzle array across the printzone.

In one illustrated embodiment, the support member comprises a shoe member that has a support surface of a low friction material over which the interior surface of the belt slides, with the shoe support surface being parallel to the belt support zone. The system may include an optional printhead-to-media spacing adjustment system that couples the shoe member to the printing mechanism chassis to selectively move the belt support zone toward or away from the printhead. In another illustrated embodiment, the media support system may include a second support member that is parallel to, and spaced apart from, the at least one support member to suspend the belt therebetween to define the support zone.

In yet another illustrated embodiment, the endless belt is a unitary belt extending across the printzone. In another embodiment, the support system further includes plural endless belts spaced apart from one another across the printzone. In another variation, the exterior surface of the endless belt has one or more ribs projecting upwardly therefrom and extending longitudinally in a direction perpendicular to the scanning axis. In still a further embodiment, the endless belt comprises a foraminous belt and the media support system may have a vacuum system having a vacuum source and an inlet plenum. The inlet plenum extends along the interior surface of the foraminous belt adjacent the printzone to pull media in the printzone into engagement with the support zone of the belt.

According to a further aspect of the invention, an inkjet printing mechanism is provided as including the media support system described above.

According to still another aspect of the invention, a method is provided for supporting media for printing in a printzone of an inkjet printing mechanism. The method includes the step of reciprocally moving an inkjet printhead along a scanning axis across the printzone, with the printhead having a nozzle array that is perpendicular to the scanning axis. In a driving step, an endless belt having an interior surface and an exterior surface is driven through the printzone. In a feeding step, media is fed through the printzone on a belt support zone defined by a portion of the belt exterior surface. In a supporting step, the belt interior surface opposite the support zone is supported with at least one support member that is parallel to the scanning axis so the support zone positions the media thereon in a print plane under the length of the nozzle array as the printhead moves reciprocally across the printzone during said moving step.

An overall goal of the present invention is to provide an inkjet printing mechanism which reliably produces clear crisp images while accurately advancing a sheet through a printzone during printing, including printing of posters and other images having a high ink content.

A further goal of the present invention is to provide a system and method of supporting a sheet of media uniformly under a wide swath inkjet printhead, such as one having a swath width on the order of at least 20 mm to 25 mm.

DETAILED DESCRIPTION OF THE PREFERRED EMBODIMENTS

Figure 1:
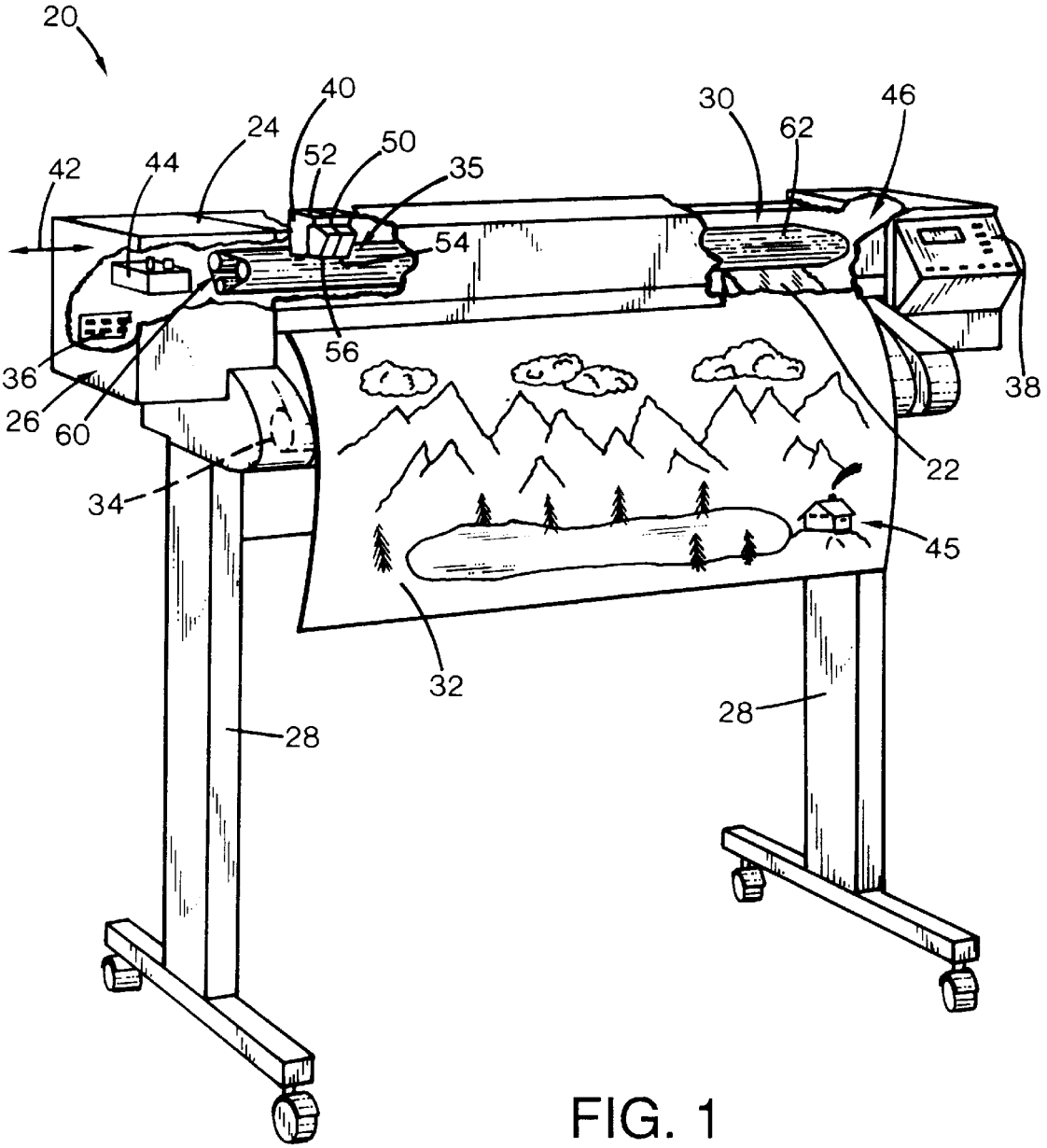
FIG. 1 is a perspective view of one form of an inkjet printing mechanism, here an inkjet plotter, employing one form of a large inkjet print swath media support system of the present invention for maintaining a uniform spacing between print media and an inkjet printhead having a large print swath, for instance about 25 mm (one inch) wide.

FIG. 1 illustrates an embodiment of an inkjet printing mechanism, here shown as an inkjet plotter 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material, together forming a print assembly portion 26 of the plotter 20. While it is apparent that the print assembly portion 26 may be supported by a desk or tabletop, it is preferred to support the print assembly portion 26 with a pair of leg assemblies 28. A print media handling system 30, described in further detail below, feeds a continuous sheet of print media 32 supplied typically on a roller 34 through a print zone 35. The print media may be any type of suitable sheet material, such as paper, poster board, fabric, transparencies, mylar, and the like, but for convenience, the illustrated embodiment is described using paper as the print medium.

The plotter 20 also has a plotter controller, illustrated schematically as a microprocessor 36, that receives instructions from a host device, typically a computer, such as a personal computer or a computer aided drafting (CAD) computer system (not shown). The plotter controller 36 may also operate in response to user inputs provided through a key pad and status display portion 38, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

A carriage guide rod mounted to the chassis 22 slideably supports an inkjet carriage 40 for travel back and forth, reciprocally, by a carriage drive motor across the print zone 35 along a scanning axis 42. The carriage drive motor operates in response to a control signal received from the controller 36. One suitable type of carriage support system is shown in U.S. Pat. No. 5,342,133, assigned to Hewlett-Packard Company, the assignee of the present invention. The carriage 40 is also propelled along the guide rod into a servicing region housing a service station 44, located within the interior of casing 24. The service station 44 may be any type of servicing device, sized to service the particular printing cartridges used in a particular implementation. Service stations, such as those used in commercially available plotters and printers, typically include wiping, capping and priming devices, as well as a spittoon portion, as described above in the background portion. Suitable preferred service stations are commercially available in DeskJet® color inkjet printers, as well as in DesignJet® color plotters, all produced by Hewlett-Packard Company, of Palo Alto, Calif., the present assignee.

The pen carriage 40 is advanced across the printzone 30 by the carriage drive motor in response to control signals received from the plotter controller 36. To provide carriage positional feedback information to controller 36, a metallic encoder strip extends along the length of the print zone 35 and over the service station 44. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art.

Upon completion of printing an image 45, such as the landscape scene illustrated in FIG. 1, the carriage 40 latches onto a cutting mechanism portion of the media handling system 30, such as a cutter which is normally housed at a home position within the casing 24 behind the region of keypad 38 as indicated generally by item 46. The carriage 40 then drags the cutter across the final trailing portion of the media, here past the top of image 45, to sever the portion of the media sheet with image 45 from the remainder of the roll 34. After cutting, the carriage 40 then returns the cutter to its home position at 46. Suitable preferred cutter mechanisms are commercially available in DesignJet® 650° C. and 750° C. color plotters, produced by Hewlett-Packard Company, of Palo Alto, Calif., the present assignee. Of course, sheet severing may be accomplished in a variety of other ways known to those skilled in the art. Moreover, the illustrated inkjet printing mechanism may also be used for printing images on pre-cut sheets, rather than on media supplied in a roll 34.

In the print zone 35, the media sheet 32 receives ink from an inkjet cartridge, such as a monochrome black ink cartridge 50 and/or a color ink cartridge 52. The cartridges 50 and 52 are also often called "pens" by those in the art. The illustrated color pen 52 is a tri-compartment, tri-color pen having three reservoirs that carry cyan, yellow and magenta color inks, whereas the monochrome black pen 50 has a single reservoir carrying black ink. In some embodiments, a set of discrete monochrome pens may be used, for instance, black, cyan, yellow and magenta pens, such as supplied in the DesignJet® 650° C. and 750° C. color plotters, produced by Hewlett-Packard Company, the present assignee. An "off-axis" system, having main stationary reservoirs for each ink (black, cyan, magenta, yellow) with a tube supply to their respective printheads, may be substituted for the replaceable cartridges 50, 52, so only a semi-permanent printhead assembly and a small ink supply would be propelled by a carriage across the print zone 35. In an off-axis system, the semi-permanent printhead is replenished by ink conveyed through flexible tubing from a stationary main reservoir, which is located "off-axis" from the path of printhead travel. As used herein, the term "pen" or "cartridge" also refers to such an off-axis system, as well as the illustrated replaceable printhead cartridges 50, 52.

The illustrated pens 50, 52 have printheads 54, 56 respectively, for selectively ejecting the ink. While the color pen 52 may contain a pigment based ink, for the purposes of illustration, pen 52 is described as containing three dye based ink colors. The black ink pen 50 is illustrated herein as containing a pigment based ink. It is apparent that other types of inks may also be used in pens 50, 52, such as paraffin based inks, as well as hybrid or composite inks having both dye and pigment characteristics.

Each printhead 54, 56 has an orifice plate with a plurality of nozzles formed therethrough in a pair of parallel, side-by-side linear arrays. Here, the monochrome black pen 50 has a large swath printhead, illustrated as having a pair of linear nozzle arrays each with a length of about 25 mm (about one inch) or greater, as mentioned in the Background portion above. It is apparent that the media support systems illustrated herein may also be used with printheads having shorter or longer nozzle arrays, such as one on the order of about 21 mm (⅝ of an inch). As noted above, the carriage 40 may be modified to carry the black pen 50 and three or more discrete monochrome color pens, which may each also have large swath printheads.

The illustrated printheads 54, 56 are thermal inkjet printheads, although other types of printheads may be used, such as piezoelectric printheads. The printheads 54, 56 include a substrate layer having a plurality of resistors which are associated with the nozzles. Upon energizing a selected resistor, a bubble of gas is formed to eject a droplet of ink from an associated nozzle and onto sheet 32 in the print zone 35. Ink may also be ejected into a spittoon portion of the service station 44 during servicing, or to clear plugged nozzles. The printhead resistors are selectively energized in response to firing command control signals delivered by a multi-conductor strip from the controller 36 to the printhead carriage 40.

Figure 2:
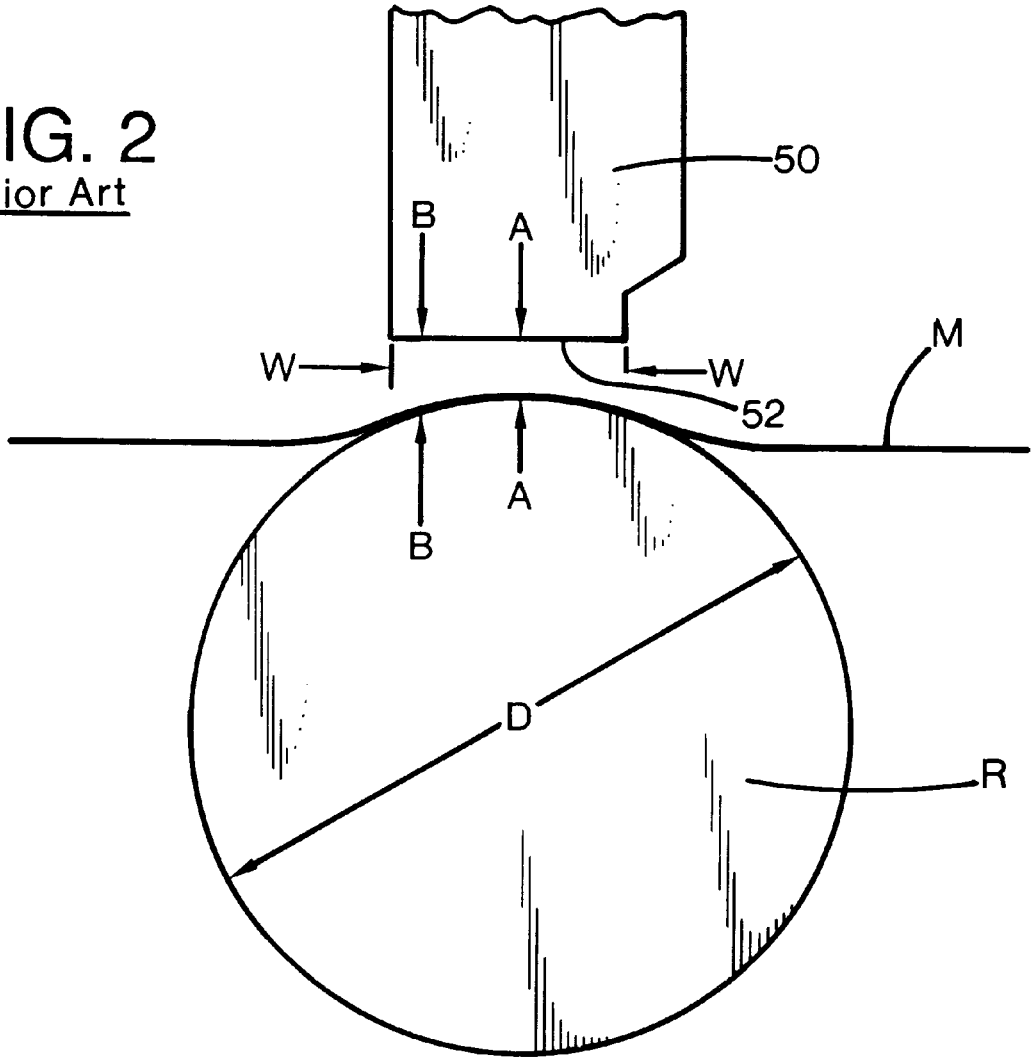
FIG. 2 Prior Art
FIG. 2 is an enlarged side elevational view of an attempt to employ a prior art media support system with the new wide swath printhead of FIG. 1.

Before describing a preferred embodiment of the media handling system 30 constructed in accordance with the present invention, the inadequacies of the earlier media support system when used with the new larger printhead 50 will be discussed. FIG. 2 shows a side elevational view of an old roller R having a diameter D of about 75 mm (about three inches). The roller R is propelling a sheet of media M under the new wide swath inkjet cartridge 50, which has printhead 52 with the new print larger swath width W of about 25 mm (one inch). The media-to-printhead spacing is not uniform under the nozzle array, as shown by the different spacings between arrows B and that between arrows A. The A arrows are located near the middle of the nozzle array and have a closer spacing than the spacing between the arrows B, which are located at the end of the nozzle array. The curvature of the roller R causes the flight distance of the ink expelled from the nozzles at each end of the array (arrows B) to be greater than that near the middle (arrows A). This variation in flight distance yields visually detectable and unacceptable print defects. While a simple answer may be to increase the roller diameter, in a commercially viable plotter, such a larger diameter roller would not be acceptable. Such a larger diameter roller would not only increase the cost and weight of the plotter, but it would also increase the overall size of the plotter, an undesirable side effect in today's compact office environments.

Large Inkjet Print Swath Media Support Systems

Figure 3:
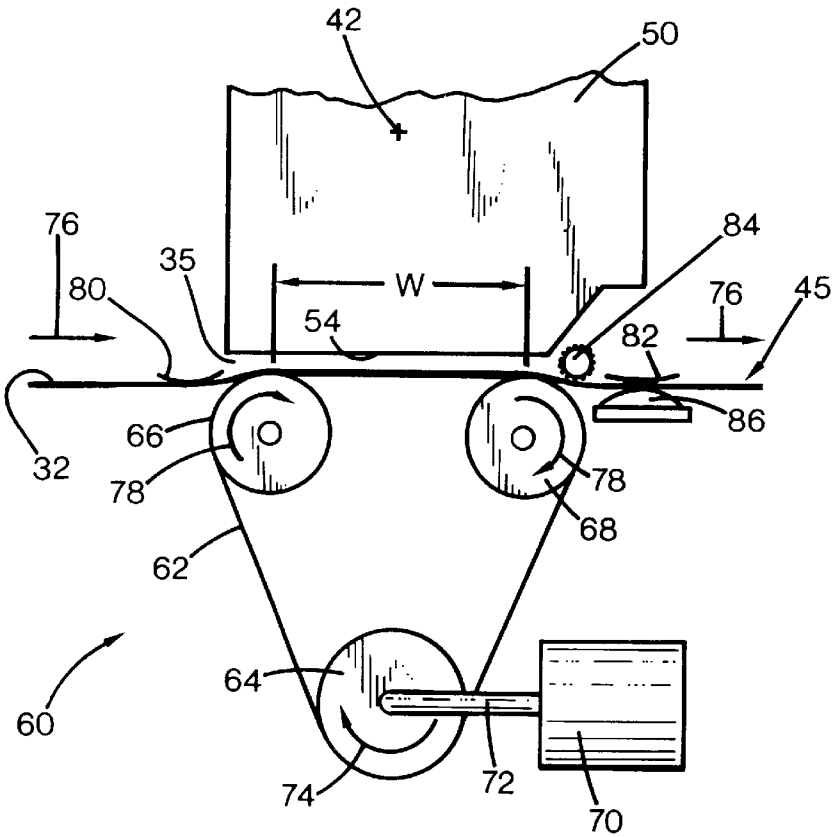
FIG. 3 is an enlarged side elevational view of the media support and drive system of FIG. 1.

FIG. 3 shows a first embodiment of the media handling system 30 as including a large inkjet print swath media support and transport system 60, constructed in accordance with the present invention. The incoming media may be delivered over a series of conventional media guides and/or rollers from the supply roll 34, for example as shown in U.S. Pat. No. 5,342,133 ("the '133 patent"). The '133 patent is described in the Background portion above as including the old roller R shown in FIG. 2 for supporting and transporting the media through the print zone.

The new support system 60 replaces roller R with an endless belt 62 that extends along the length of the printzone 35. The belt 62 is supported by at least two, and preferably three rollers, such as a drive roller 64, an up-stream support roller 66, and a down-stream support roller 68. Preferably, the rollers 64–68 extend along the length of the printzone 35, engaging an interior surface of belt 62. A media drive motor 70 may be directly coupled by shaft 72, or another coupling mechanism, such as a gear assembly for instance, to drive the roller 64 in the direction indicated by curved arrow 74 to advance the media 32 through the printzone 35. The drive motor 70 may be a stepper motor that operates in response to a control signal received from the plotter controller 36 to move the media in one-swath increments through the printzone, as well as in fractional amounts of a one-swath increment for printing using various shingling print modes and the like. The direction of media advance through the printzone 35 is indicated by the straight arrows 76, while the corresponding direction of rotation of the support rollers 66, 68 is indicated by curved arrows 78.

The support rollers 66, 68 suspend the belt 62 at a uniform distance from printhead 54, as well as printhead 56, across the entire length of the nozzle arrays, indicated by dimension W in FIG. 3, which corresponds to the print swath width for pen 50. The media 32 is supported on a support zone along the top of the exterior surface of belt 62 throughout the printzone 35, between rollers 66, 68. Thus, the media 32 is in contact with belt 62 under entire printzone 35, both along the entire swath width and over the entire length of the printzone 35. To keep the media 32 flat against the support zone of belt 62, the rollers 66, 68 may be elevated from the otherwise level travel of media 32, as illustrated in FIG. 3. To further secure the media 32 along the belt support zone, a media retention system may be employed up stream and/or down stream from the printzone 35, such as guide shims 80 and 82, or pinch rollers, for instance elastomeric rollers or star-wheel metallic rollers 84, or other conventional retention systems known it the art.

Advantageously, the drive roller 64 is located below the downstream support roller 68, which allows the belt 62 to drop away quickly from the plane of the print zone 35. This quick exit of the support belt 62 from the post-print zone allows placement of cockle solutions in this region. The term "cockle" refers to the tendency of ink-saturated media to bow and become wavy as it expands due to absorption of the liquid components of the ink between the media fibers. Various cockle solutions have been proposed in the art, such as a series of support ribs, for instance, as shown in U.S. Pat. No. 5,393,151, assigned to Hewlett-Packard Company.

Figure 4:
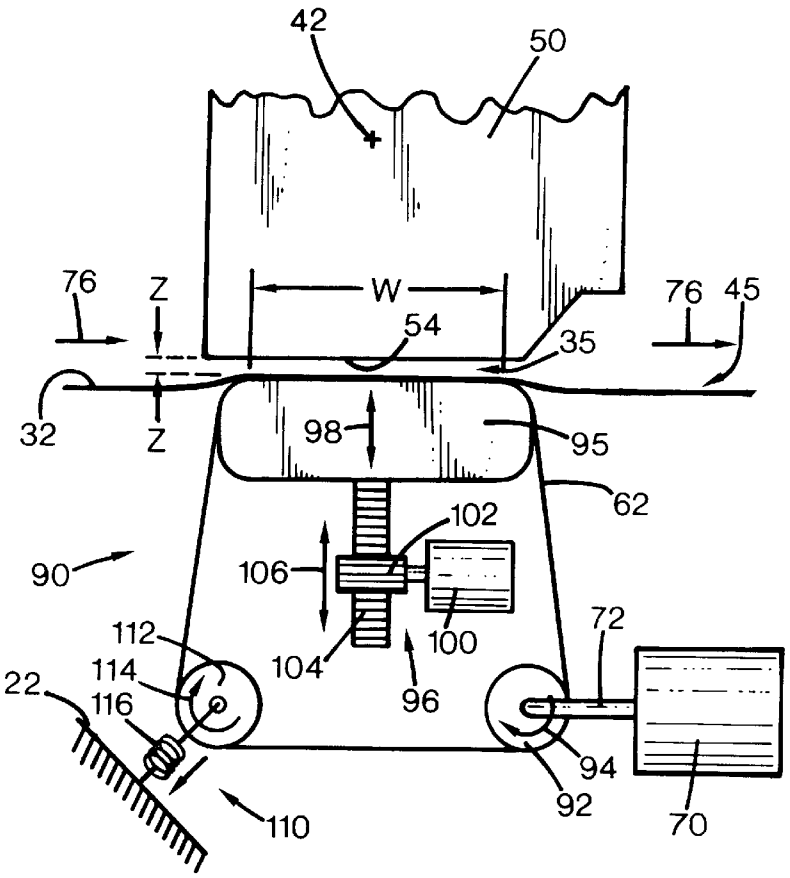
FIG. 4 is an enlarged side elevational view of a second embodiment of a media support and drive system of the present invention.

FIG. 4 shows a second embodiment of a large inkjet print swath media support and transport system 90, constructed in accordance with the present invention, which may be substituted for portions of system 60. Here, the endless belt 62 is driven by drive roller 92, which may be coupled by shaft 72 to motor 70 as described above, to rotate roller 92 as indicated by arrow 94. The support rollers 66, 68 have been replaced with a support shoe 95, which has an upper surface that supports the interior surface of belt 62 in the printzone 35 in a support zone at a uniform drop flight distance Z from the printhead 54. To keep the media 32 flat against the exterior surface of belt 62 in the support zone, the shoe 95 may be elevated from the otherwise level travel of media 32, as illustrated in FIG. 4. It is apparent that the support system 90 may include a media retention system and/or cockle solutions, as described above with respect to item numbers 80–86.

The support system 90 may have an optional printhead-to-media spacing adjustment system, such as mechanism 96, for moving support shoe 95 toward or away from the printhead 54, as indicated by arrows 98, which uniformly changes the drop flight distance Z. In the illustrated embodiment, the spacing adjustment mechanism 96 comprises a rack and pinion gear assembly driven by a motor 100. Here, the motor 100 drives a pinion gear 102, which in turn drives a rack gear 104, as indicated by arrow 106. The rack gear 104 is coupled to the shoe 95 to selectively vary the printhead-to-media spacing across the entire printzone 35. The motor 100 may operate in response to a control signal from the plotter controller 36, or in response to an input received from the keypad 38 to vary the printhead-to-media spacing Z, for example, to increase the distance Z to accommodate thicker media, such as poster board as compared to paper, or to accommodate different media textures, such as mylar or transparencies as compared to paper. It is apparent that other mechanisms may be used to impart the elevational change 98 to shoe 95, such as a manually operated lever system, or other mechanical or electromechanical linkage mechanisms.

When employing the printhead-to-media spacing adjustment system 96, the belt 62 must accommodate the various spacings while maintaining a tensioned condition across the shoe 95 to provide the desired uniform media support throughout the printzone 35. To tension the belt 62 when distance Z is increased by lowering shoe 95, the support system 90 has a tensioning system, such as a belt tensioner 110. The illustrated belt tensioner 110 has a tensioning roller 112 that rotated in direction 114 when the system 90 is feeding media. The roller shaft is coupled by a biasing mechanism, such as tension spring 116, to the chassis 22. When the spacing Z is decreased, the elevating mechanism 96 moves shoe 95 (and media supported thereabove by belt 62) toward the printhead 54, which tensions spring 116. When the spacing Z is increased, spring 116 pulls tensioning roller 112 toward chassis 22 which takes up any resulting slack in belt 62.

Figure 5:
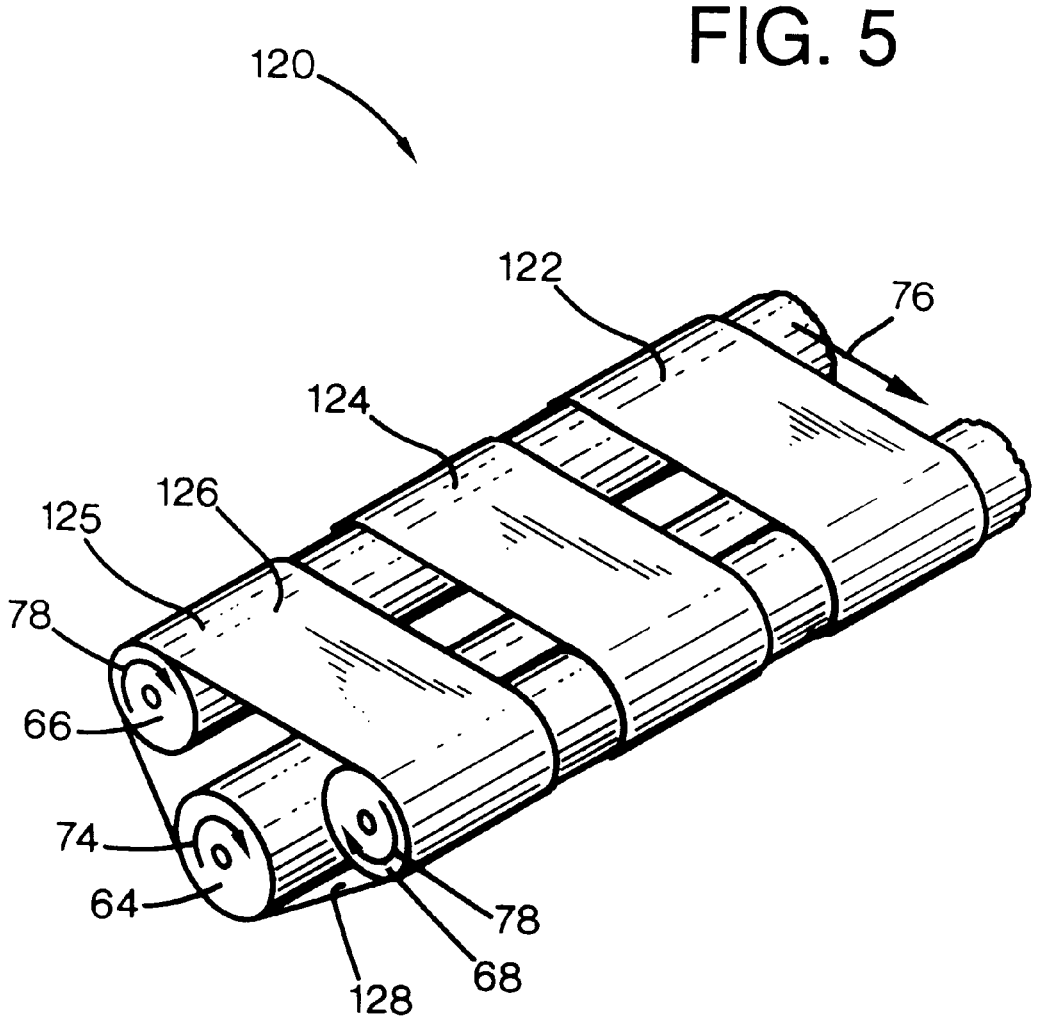
FIG. 5 is an enlarged perspective view of a third embodiment of a media support and drive system of the present invention.

FIG. 5 shows a third embodiment of a large inkjet print swath media support and transport system 120, constructed in accordance with the present invention, which may be substituted for portions of system 60 or 90. Here, the single unitary belt 62 which extends across the entire printzone 35, has been replaced by a series of narrower belts, such as belts 122, 124 and 125. Note that in FIG. 5, only the left portion of the entire drive system 120 is shown for the purposes of illustration. Each of these narrower belts 122, 124, 125 has an exterior surface 126, a portion of which when suspended between rollers 66 and 68 defines a media support zone, as described above for belt 62. Each belt 122, 124, 125 also has an interior surface 128 which is engaged by the drive roller 64. It is apparent that support system 90 of FIG. 4 may be substituted for the illustrated three roller support system when using the plural belt support system 120.

In the illustrated embodiment, where the flat portion of the media support zone is substantially parallel to the printheads 54, 56 which are about 25 mm (one inch) wide, the width of each belt 122, 124, 125 may preferably be about 25 mm (one inch) wide also, with a spacing between adjacent belts being about half the belt width. It is apparent that other sizes, spacings, and numbers of belts may be substituted for those illustrated. The media sheet 32 is suspended between adjacent belts, which may assist in cockle control, by allowing the media to buckle downward in a controlled fashion in the inter-belt spacings.

Figure 6:
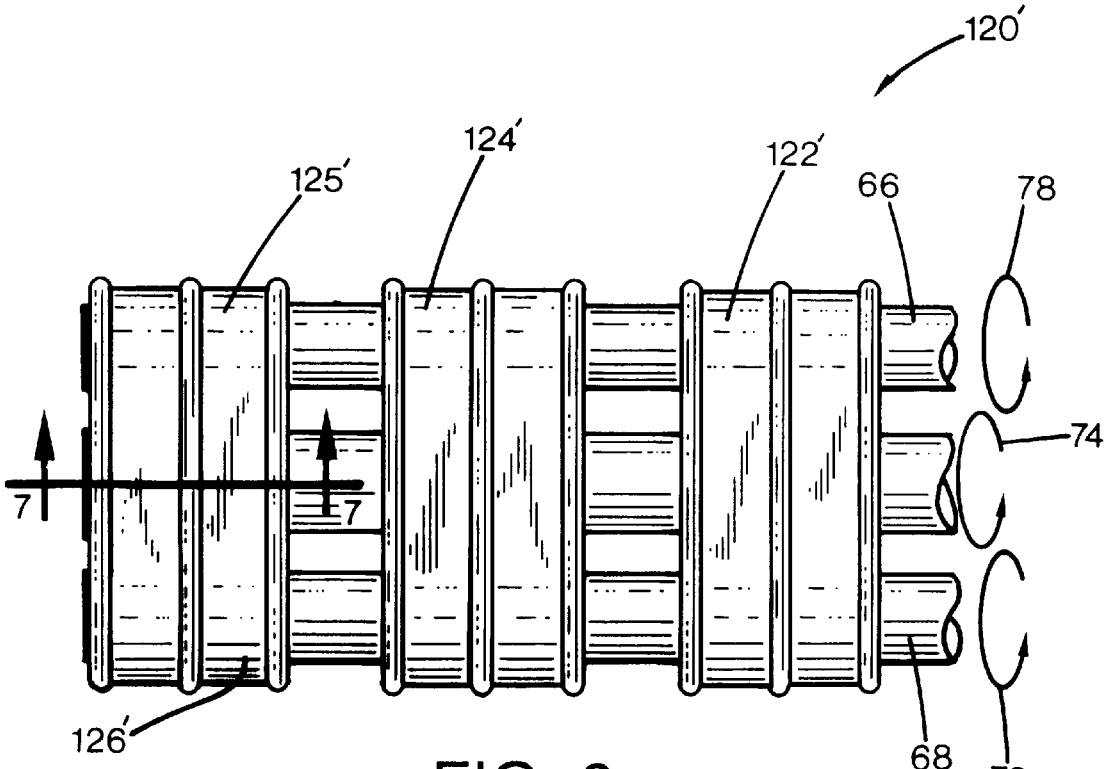
FIG. 6 is an enlarged top plan view of a fourth embodiment of a media support and drive system of the present invention.
Figure 7:
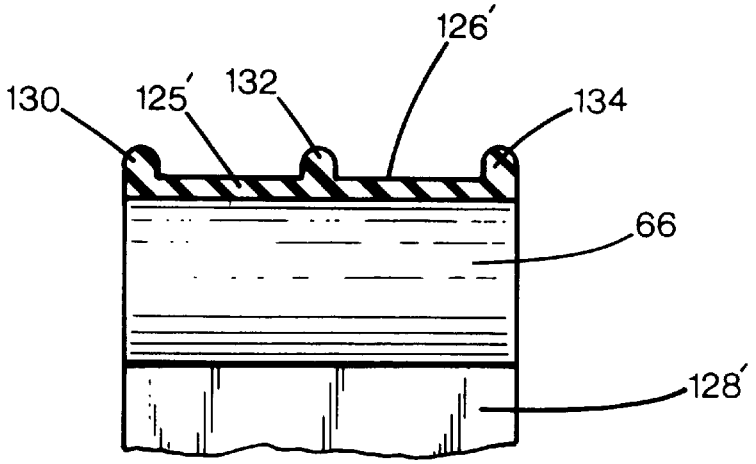
FIG. 7 is an enlarged front sectional view taken along lines 7—7 of FIG. 6.

To better control cockle, the single belt 62 or the plural belt system 120 may employ cockle-control ribs on the exterior surfaces of the belts. For example, FIGS. 6 and 7 show a fourth embodiment of a large inkjet print swath media support and transport system 120', constructed in accordance with the present invention, which may be substituted for portions of system 60 or system 120. Here, the support system 120' is illustrated as having a series of belts, such as belts 122', 124' and 125', each having an exterior and interior surfaces 126' and 128', respectively. The belts 122', 124' and 125' each have at least one cockle control rib, and given the illustrated proportions, preferably three spaced apart ribs 130, 132, 134. During printing, the media sheet 32 is suspended between adjacent ribs, so when saturated with ink, the media may sag down between the adjacent ribs. It is apparent that while the ribs 130–134 are illustrated as bands extending around the belt periphery, they may also be short segments, arranged parallel to one another or otherwise. Indeed, the cockle solution ribs may be of different shapes, and in some implementations, they may be arranged in other patterns, or even randomly.

Figure 8:
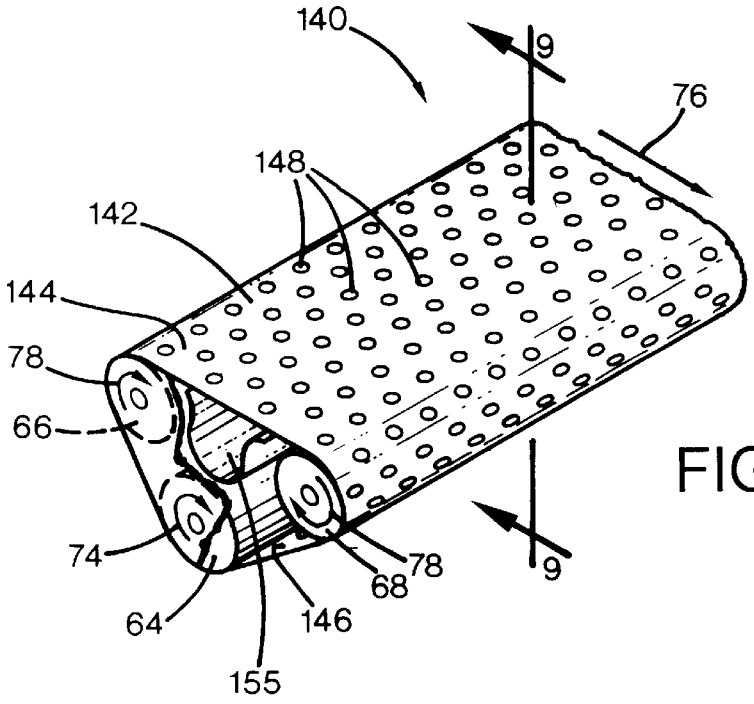
FIG. 8 is an enlarged perspective view of a fifth embodiment of a media support and drive system of the present invention.
Figure 9:
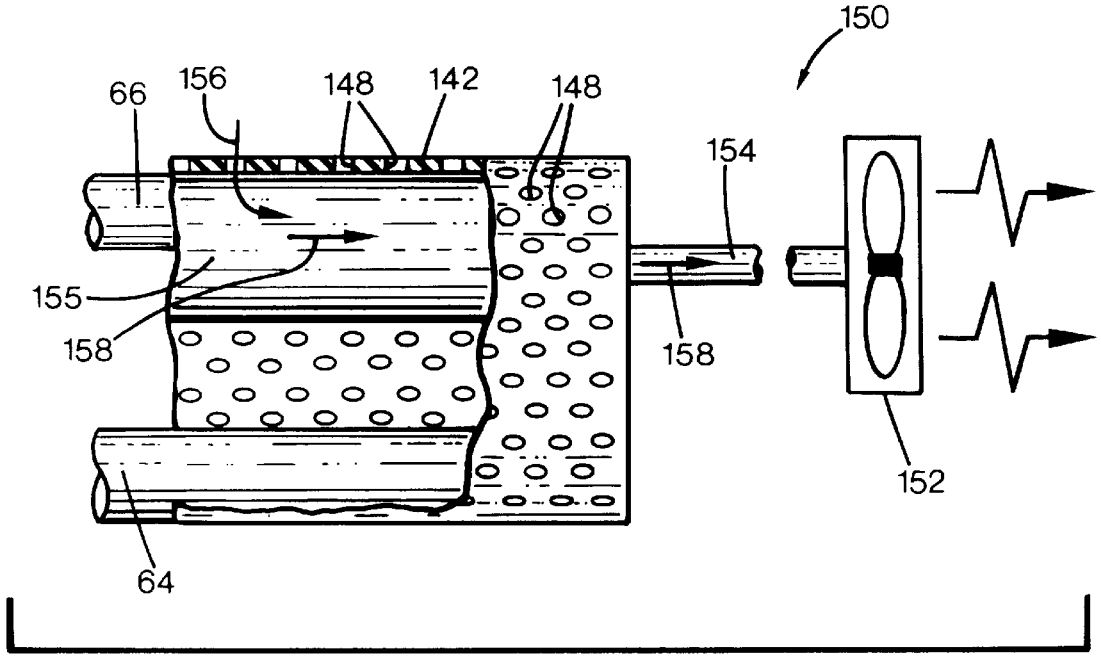
FIG. 9 is an enlarged, partially schematic and partially cut away, front sectional view taken along lines 9—9 of FIG. 8.

FIGS. 8 and 9 show a fifth embodiment of a large inkjet print swath media support and transport system 140, constructed in accordance with the present invention, which may be substituted for portions of system 60, 90, 120, or 120'. Here, the unitary belt 62 of FIGS. 1 and 3–4 have been replaced by a unitary foraminous belt 142 having an exterior surface 144 that supports the media in a support zone between support rollers 66 and 68, and an interior surface 146 driven by roller 64. The term "foraminous" refers to the series of openings extending through the belt between the interior and exterior surfaces 146, 144. While these openings through belt 142 may have various shapes and arrangements, the illustrated belt 142 has a group of openings such as slots or holes 148, extending therethrough. It is apparent that the series of belts in FIGS. 5 and 6 may also be foraminous, with openings extending therethrough if desired.

As shown in FIG. 9, one advantage to a foraminous belt 142 is that the media support system 140 may include a vacuum system 150 for creating a region of low pressure under the belt at the support zone to pull the media sheet 32 toward the belt 142. In the illustrated embodiment, a fan unit 152 is used to create the vacuum force. A conduit 154 couples the fan 152 to an inlet plenum 155, located between support rollers 66 and 68 directly under the printzone 30. As the fan 152 operates, air is drawn through holes 148, as indicated by arrow 156, then through plenum 155 and conduit 154, as indicated by arrows 158, and is finally the air is vented to atmosphere after passing through fan 152.

Thus, the foraminous belt support system 140 may be used instead of, or in addition to, the media guides 80, 82 and rollers 84. Furthermore, the vacuum system 150 may also be employed with the plural belt systems 120, 120', whether the plural belts are foraminous or not. That is, spacings between adjacent belts may serve the same purpose as the belt holes 148 to pull the media toward the belt exterior surface. Moreover, it is apparent that the support shoe 95 of FIG. 4 may be substituted for the three roller system shown in FIGS. 8 and 9. In such a system, the shoe 95 may be readily modified to serve as the inlet plenum 155, for example, by placing a series of openings in the upper support surface of shoe 95, under the printzone 30. The modified shoe then may be coupled to fan 152 as described above with respect to FIG. 9.

In operation, a method is provided for supporting media 32 for printing in the printzone 30. The method includes the step of reciprocally moving a large swath inkjet printhead 50, 52 along the scanning axis 42 across the printzone 30, with the printhead having a nozzle array with a length of about at least 25 mm (one inch) that is perpendicular to the scanning axis 42. In a driving step, the endless belt 62, 142, or belts 122–125, 122'–125', are driven through the printzone 30, here by drive roller 64 or 92. In a feeding step, media 32 is fed from roll 34 for instance, through the printzone 30 on a belt support zone defined by a portion of the belt exterior surface. In a supporting step, the belt interior surface opposite the support zone is supported with at least one support member 66, 68 or 95 that is parallel to the scanning axis 42 so the support zone positions the media 32 thereon in a print plane under the length of the nozzle array as the printhead 50, 52 moves reciprocally across the printzone 30 during the moving step.

The method may also include the steps of selectively moving the belt support zone toward or away from the printhead, for instance, using the optional printhead-to-media spacing adjustment system 96. In response to this adjustment, any slack may be removed from the belt 62 using the tensioner 110. The supporting step may be accomplished by supporting the belt 62, 142 or belts 122–125, 122'–125' with two members 66, 68 spaced apart from one another to suspend the belt therebetween to define the support zone along the belt exterior surface. The method may also include the steps of suspending a portion of the media between adjacent ribs in the printzone, for instance when using the ribbed belt system 120', and controlling media expansion caused by ink saturation by allowing the ink-saturated expanding portion of the media to expand between said adjacent ribs. When the driving step is accomplished using the foraminous belt 142, the method further includes the step of pulling the media in the printzone into engagement with the support zone of the belt by creating a low pressure region along the interior surface of the foraminous belt adjacent the printzone, for instance by applying a vacuum force with system 150 along the interior surface 146 of the foraminous belt 142 adjacent the printzone.

Conclusion

Thus, a variety of advantages are realized by implementing either embodiment of the large print swath media support and transport systems 60 or 90. Both support systems 60, 90 maintain a uniform media-to-printhead spacing throughout the entire printzone. This uniform spacing assures that each ink droplet fired from the printheads 54, 56 travel the same flight distance from the nozzle plate to the media surface, regardless of which nozzle along the length of the array fired the droplet. This equal flight distance provides a higher quality image than obtainable using the earlier roller support system with the larger swath printhead, as discussed with respect to FIG. 2.

Moreover, by supporting the media 32 along the entire printzone, rather than merely along the edges, as proposed in the earlier system, advantageously prevents media sag near the center of the printzone, particularly when printing photographic type images requiring large quantities of ink. Furthermore, the support system 90 illustrates one manner of varying the media-to-printhead spacing Z uniformly across the entire printzone 35. A cockle control solution may also be incorporated into the endless belt drive concept by employing ribs that project upwardly from the exterior surface of the belt to allow ink-saturated media to expand downwardly between adjacent ribs.

We claim:

1. A media support system for an inkjet printing mechanism having a chassis and an inkjet printhead mounted thereto for reciprocal movement along a scanning axis across a printzone, with the printhead having a nozzle array with a length that is perpendicular to the scanning axis, comprising:

an endless belt having an interior surface and an exterior surface, wherein the exterior surface of the endless belt has plural ribs projecting upwardly therefrom, with each rib extending longitudinally in a direction perpendicular to the scanning axis to support the media along an undersurface thereof without protruding therethrough, and with each rib being spaced apart from an adjacent rib to suspend a portion of the media therebetween when in said printzone;

a transport system comprising a drive member that engages the belt, and a drive motor that selectively drives the drive member; and at least one support member, parallel to the scanning axis, that engages the interior surface of the belt adjacent the printzone to define a support zone along a portion of the belt exterior surface to support media thereon in a print plane under the length of the nozzle array across the printzone.

2. A media support system according to claim 1, wherein said at least one support member comprises a shoe member having a support surface of a low friction material over which the interior surface of the belt slides, with the shoe support surface being parallel to the belt support zone.

3. A media support system according to claim 2, further including a printhead-to-media spacing adjustment system that couples the shoe member to the printing mechanism chassis to selectively move the belt support zone toward or away from the printhead.

4. A media support system according to claim 3, wherein the printhead-to-media spacing adjustment system comprises a rack gear coupled to the shoe member, a pinion gear that engages the rack gears and a motor, supported by the chassis, that drives the pinion gear.

5. A media support system according to claim 3, further including a tensioning system comprising a tensioning roller that engages the belt, and a biasing mechanism that joins the tensioning roller to the chassis to urge the tensioning roller to remove any slack in the belt after any selective movement of the belt support zone toward or away from the printhead. by the printhead-to-media spacing adjustment system.

6. A media support system according to claim 5, wherein the tensioning roller engages the interior surface of the belt, and the biasing mechanism comprises a tension spring that urges the tensioning roller toward the chassis.

7. A media support system according to claim 1, further including a second support member parallel to and spaced apart from said at least one support member to suspend the belt therebetween to define the support zone.

8. A media support system according to claim 7, wherein the drive member comprises a drive roller that engages the interior surface of the belt and is parallel to the scanning axis.

9. A media support system according to claim 1, wherein the endless belt comprises a flexible endless belt, and the drive member comprises a drive roller that engages the interior surface of the belt parallel to the scanning axis and extends along the printzone.

10. A media support system according to claim 1:

wherein the belt support zone has a feed zone across which fresh media is delivered to the printzone, and a discharge zone over which media is discharged from the printzone; and further including a cockle solution system, which avoids cockling of the media after printing thereon, is supported by the printing mechanism chassis adjacent the belt discharge zone.

11. A media support system according to claim 10, wherein:

the drive member and said at least one support member are arranged to pull the belt away from a plane defined by the support zone adjacent the discharge zone; and the cockle solution comprises plural rib members spaced apart from one another and each having a length extending perpendicular to the scanning axis.

12. A media support system according to claim 1, further including a media retention system, which assists in securing the media to the belt exterior surface along the belt support zone, is supported by the chassis and having plural media engagement members positioned to engage a print surface of the media that faces the printhead when the media is in the printzone.

13. A media support system according to claim 12, wherein the plural media engagement members each comprise a guide shim located adjacent the support zone to bias the media toward the belt support zone.

14. A media support system according to claim 12, wherein the plural media engagement members each comprise a pinching roller member located adjacent the support zone to bias the media toward the belt support zone, with said pinching roller member comprising a star wheel.

15. A media support system according to claim 1, wherein each rib forms an endless band extending around the exterior surface of the belt.

16. A media support system according to claim 1, wherein each rib is spaced apart from an adjacent rib to suspend a portion of the media therebetween.

17. A media support system according to claim 1, wherein the endless belt is a unitary belt extending across the printzone.

18. A media support system according to claim 1, further including plural endless belts spaced apart from one another across the printzone.

19. A media support system according to claim 18, wherein the exterior surface of each endless belt has at least one of said plural ribs projecting upwardly therefrom.

20. A media support system according to claim 18, further including a vacuum system having a vacuum source and an inlet plenum coupled thereto, with the inlet plenum extending along the interior surface of the belt adjacent the printzone to pull media in the printzone into engagement with the support zone of the belt.

21. A media support system according to claim 20 wherein:

the media support system further includes a second support member parallel to and spaced apart-from said at least one support member to suspend the belt therebetween to define the support zone; and the inlet plenum is located between the second support member and said at least one support member.

22. A media support system according to claim 20, wherein:

said at least one support member comprises a shoe member having a support surface of a low friction material over which the interior surface of the belt slides, with the shoe support surface being parallel to the belt support zone; and the shoe member defines an interior cavity having an outlet port coupled to the vacuum source, with the shoe member also defining plural inlet port openings extending therethrough from the support surface to the interior cavity, so the shoe member serves as the inlet plenum of the vacuum system.

23. An inkjet printing mechanism, comprising:

a chassis;

a carriage supported by the chassis for reciprocal movement along a scanning axis across a printzone;

an inkjet printhead having a nozzle array with a length, with the printhead supported by the carriage for said reciprocal movement with the length of the nozzle array perpendicular to the scanning axis; and a media support system, comprising;

an endless belt having an interior surface and an exterior surface, wherein the exterior surface of the endless belt has plural ribs projecting upwardly therefrom, with each rib extending longitudinally in a direction perpendicular to the scanning axis to support the media along an undersurface thereof without protruding therethrough, and with each rib being spaced apart from an adjacent rib to suspend a portion of the media therebetween when in said printzone;

a transport system comprising a drive member that engages the belt, and a drive motor that selectively drives the drive member; and at least one support member, parallel to the scanning axis, that engages the interior surface of the belt adjacent the printzone to define a support zone along a portion of the belt exterior surface to support media thereon in a print plane under the length of the nozzle array across the printzone.

24. An inkjet printing mechanism according to claim 23, wherein said at least one support member comprises a shoe member having a support surface of a low friction material over which the interior surface of the belt slides, with the shoe support surface being parallel to the belt support zone.

25. An inkjet printing mechanism according to claim 24, further including:

a printhead-to-media spacing adjustment system that couples the shoe member to the printing mechanism chassis to selectively move the belt support zone toward or away from the printhead; and a tensioning system comprising a tensioning roller that engages the interior surface of the belt, and a biasing mechanism that urges the tensioning roller toward the chassis to remove any slack in the belt after any selective movement of the belt support zone toward or away from the printhead by the printhead-to-media spacing adjustment system.

26. An inkjet printing mechanism according to claim 23, further including a second support member parallel to and spaced apart from said at least one support member to suspend the belt therebetween to define the support zone.

27. An inkjet printing mechanism according to claim 23, wherein the endless belt is a unitary belt extending across the printzone.

28. An inkjet printing mechanism according to claim 23, further including plural endless belts spaced apart from one another across the printzone.

29. An inkjet printing mechanism according to claim 28, wherein the exterior surface of each endless belt has at least one of said plural ribs projecting upwardly therefrom, with the rib extending longitudinally in a direction perpendicular to the scanning axis.

30. An inkjet printing mechanism according to claim 28, further including:

a vacuum system having a vacuum source and an inlet plenum coupled thereto, with the inlet plenum extending along the interior surface of the belt adjacent the printzone to pull media in the printzone into engagement with the support zone of the belt.

31. A method of supporting media for printing in a printzone of an inkjet printing mechanism, comprising the steps of:

reciprocally moving an inkjet printhead along a scanning axis across the printzone, with the printhead having a nozzle array with a length that is perpendicular to the scanning axis;

driving an endless belt having an interior surface and an exterior surface through the printzone, with the belt exterior surface having plural ribs projecting upwardly therefrom, with each rib having a length perpendicular to the scanning axis, and with each rib being spaced apart from an adjacent rib;

feeding media through the printzone on a belt support zone defined by a portion of the belt exterior surface;

supporting the belt interior surface opposite the support zone with at least one support member that is parallel to the scanning axis so the support zone positions the media thereon in a print plane under the length of the nozzle array as the printhead moves reciprocally across the printzone during said moving step;

supporting an undersurface of the media with said ribs without said ribs protruding, through the media;

suspending a portion of the media between adjacent ribs in the printzone;

saturating a portion of the media suspended between adjacent ribs when printing which causes media expansion; and controlling said media expansion by allowing the ink-saturated expanding portion of the media to expand into a region between said adjacent ribs.

32. A method according to claim 31, wherein the feeding step comprises feeding media from a roll supply of sheet media.

33. A method according to claim 31, further including the steps of selectively moving the belt support zone toward or away from the printhead, and in response thereto, removing any slack from the belt.

34. A method according to claim 31, further including the step of selectively moving the belt support zone toward or away from the printhead.

35. A method according to claim 34, wherein the at least one support member of the supporting step comprises a shoe member having a support surface of a low friction material over which the interior surface of the belt slides during the driving step, with the shoe support surface being parallel to the belt support zone.

36. A method according to claim 31, wherein the supporting step comprises also supporting the belt with a second support member parallel to and spaced apart from said at least one support member to suspend the belt therebetween to define the support zone.

37. A method of supporting media for printing in a printzone of an inkjet printing mechanism, comprising the steps of:

reciprocally moving an inkjet printhead along a scanning axis across the printzone, with the printhead having a nozzle array with a length that is perpendicular to the scanning axis;

driving an endless belt having an interior surface and an exterior surface through the printzone, with the belt exterior surface having plural ribs projecting upwardly therefrom, with each rib having a length perpendicular to the scanning axis, and with each rib being spaced apart from an adjacent rib;

feeding media through the printzone on a belt support zone defined by a portion of the belt exterior surface;

supporting the belt interior surface opposite the support zone with at least one support member that is parallel to the scanning axis so the support zone positions the media thereon in a print plane under the length of the nozzle array as the printhead moves reciprocally across the printzone during said moving step;

suspending a portion of the media between adjacent ribs in the printzone;

saturating a portion of the media suspended between adjacent ribs when printing which causes media expansion;

controlling said media expansion by allowing the ink-saturated expanding portion of the media to expand between said adjacent ribs;

the driving step comprises driving plural endless belts each having at least one of said plural ribs; and pulling the media in the printzone into engagement with the support zone of the belt by creating a low pressure region along the interior surface of said plural endless belts adjacent the printzone.

38. A method according to claim 37, wherein the pulling step comprises creating the low pressure region by applying a vacuum force along the interior surface of said plural endless belts adjacent the printzone.

39. A media support system according to claim 12, wherein the plural media engagement members each comprise a pinching roller member located adjacent the support zone to bias the media toward the belt support zone, with said pinching roller member comprising a pinch roller.

* * * * *

UNITED STATES PATENT AND TRADEMARK OFFICE

CERTIFICATE OF CORRECTION

PATENT NO. : 5,992,994

DATED : November 30, 1999

INVENTOR(S) : Rasmussen, et al.

It is certified that error appears in the above-identified patent and that said Letters Patent is hereby corrected as shown below:

ON THE TITLE PAGE

In the "Inventors" Section, delete "Barcelcha" and insert therefor --Barcelona--.

Col. 6 (line 36), delete "650°C. and 750°" and insert therefor --650C and 750C--.
Col. 6 (line 37), delete "C.".
Col. 6 (line 54), delete "650°C. and 750°C." and insert therefor --650C and 750C--.

Col. 12 (line 40), delete "gears" and insert therefor --gear,--.
Col. 15 (line 36), after "protruding" delete ",".

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*